US008418784B2

(12) United States Patent
Hall et al.

(10) Patent No.: US 8,418,784 B2
(45) Date of Patent: Apr. 16, 2013

(54) CENTRAL CUTTING REGION OF A DRILLING HEAD ASSEMBLY

(76) Inventors: David R. Hall, Provo, UT (US); Thomas Morris, Spanish Fork, UT (US)

( * ) Notice: Subject to any disclaimer, the term of this patent is extended or adjusted under 35 U.S.C. 154(b) by 388 days.

(21) Appl. No.: 12/777,429

(22) Filed: May 11, 2010

(65) Prior Publication Data

US 2011/0278072 A1 Nov. 17, 2011

(51) Int. Cl.
*E21B 10/44* (2006.01)
*E21B 17/22* (2006.01)
*E21B 10/26* (2006.01)

(52) U.S. Cl.
USPC ..... 175/413; 175/323; 175/394; 175/386

(58) Field of Classification Search ..... 175/323, 175/394, 386, 388, 413, 432
See application file for complete search history.

(56) References Cited

U.S. PATENT DOCUMENTS

| | | | | |
|---|---|---|---|---|
| 616,118 | A | | 12/1889 | Kunhe |
| 465,103 | A | | 12/1891 | Wegner |
| 946,060 | A | | 1/1910 | Looker |
| 1,116,154 | A | | 11/1914 | Stowers |
| 1,183,600 | A | | 5/1916 | Bryson |
| 1,188,560 | A | | 7/1916 | Gondos |
| 1,360,908 | A | | 11/1920 | Everson |
| 1,387,733 | A | | 8/1921 | Midgett |
| 1,460,671 | A | | 7/1923 | Hebsacker |
| 1,544,757 | A | | 7/1925 | Hufford |
| 2,169,223 | A | | 8/1931 | Christian |
| 1,821,474 | A | | 9/1931 | Mercer |
| 1,879,177 | A | | 9/1932 | Gault |
| 2,054,255 | A | | 9/1936 | Howard |
| 2,064,255 | A | | 12/1936 | Garfield |
| 2,218,130 | A | | 10/1940 | Court |
| 2,320,136 | A | | 5/1943 | Kammerer |
| 2,466,991 | A | | 4/1949 | Kammerer |
| 2,540,464 | A | | 2/1951 | Stokes |
| 2,544,036 | A | | 3/1951 | Kammerer |
| 2,755,071 | A | | 7/1956 | Kammerer |
| 2,776,819 | A | | 1/1957 | Brown |
| 2,819,043 | A | | 1/1958 | Henderson |
| 2,838,284 | A | | 8/1958 | Austin |
| 2,894,722 | A | | 7/1959 | Buttolph |
| 2,963,102 | A | | 12/1960 | Smith |
| 3,135,341 | A | | 6/1964 | Ritter |
| 3,294,186 | A | | 12/1966 | Buell |
| 3,301,339 | A | | 1/1967 | Pennabaker |
| 3,379,264 | A | | 4/1968 | Cox |
| 3,429,390 | A | | 2/1969 | Bennett |
| 3,493,165 | A | | 2/1970 | Schonfield |
| 3,583,504 | A | | 6/1971 | Aalund |
| 3,720,273 | A | * | 3/1973 | McKenry et al. ..... 175/335 |
| 3,763,942 | A | * | 10/1973 | Levitt ..... 175/354 |
| 3,764,493 | A | | 10/1973 | Rosar |

(Continued)

*Primary Examiner* — Kenneth L Thompson
(74) *Attorney, Agent, or Firm* — Philip W. Townsend, III

(57) ABSTRACT

In one aspect of the invention, a drilling assembly comprises a head located on a rotational axis of the assembly and comprises at least one head element. At least one blade extends distally from the head. A plurality of blade degradation elements are rotationally supported on the blade. Each degradation element comprises an attack angle that affects the penetration rate of each degradation element and a laterally offset angle that primarily affects the rotational rate of each degradation element within their holders. The drilling assembly comprises a central cutting region. The blade degradation elements within the central cutting region form an attack angle of 15 to 20 degrees with the rotational axis of the drilling assembly.

14 Claims, 9 Drawing Sheets

U.S. PATENT DOCUMENTS 3,821,993 A 7/1974 Kniff
3,905,432 A * 9/1975 Mullins ..... 175/335
3,955,635 A 5/1976 Skidmore
3,960,223 A 6/1976 Kleine
4,081,042 A 3/1978 Johnson
4,096,917 A 6/1978 Harris
4,106,577 A 8/1978 Summers
4,109,737 A 8/1978 Bovenkerk
4,176,723 A 12/1979 Arceneaux
4,253,533 A 3/1981 Baker
4,280,573 A 7/1981 Sudnishnikov
4,304,312 A 12/1981 Larsson
4,307,786 A 12/1981 Evans
4,397,361 A 8/1983 Langford
4,416,339 A 11/1983 Baker
4,445,580 A 5/1984 Sahley
4,448,269 A 5/1984 Ishikawa
4,499,795 A 2/1985 Radtke
4,531,592 A 7/1985 Hayatdavoudi
4,535,853 A 8/1985 Ippolito
4,538,691 A 9/1985 Dennis
4,566,545 A 1/1986 Story
4,574,895 A 3/1986 Dolezal
4,640,374 A 2/1987 Dennis
2,901,223 A 8/1989 Scott
4,852,672 A 8/1989 Behrens
4,889,017 A 12/1989 Fuller
4,962,822 A 10/1990 Pascale
4,981,184 A 1/1991 Knowlton
5,009,273 A 4/1991 Grabinski
5,027,914 A 7/1991 Wilson
5,038,873 A 8/1991 Jurgens
5,119,892 A 6/1992 Clegg
5,141,063 A 8/1992 Quesenbury
5,158,147 A * 10/1992 Pavey et al. ..... 175/385
5,186,268 A 2/1993 Clegg
5,222,566 A 6/1993 Taylor
5,255,749 A 10/1993 Bumpurs
5,265,682 A 11/1993 Russell
5,361,859 A 11/1994 Tibbitts
5,366,031 A * 11/1994 Rickards ..... 175/354
5,410,303 A 4/1995 Comeau
5,417,292 A 5/1995 Polakoff
5,423,389 A 6/1995 Warren
5,507,357 A 4/1996 Hult
5,560,440 A 10/1996 Tibbitts
5,568,838 A 10/1996 Struthers
5,655,614 A 8/1997 Azar
5,678,644 A 10/1997 Fielder
5,732,784 A 3/1998 Nelson
5,794,728 A 8/1998 Palmberg
5,848,657 A 12/1998 Flood
5,896,938 A 4/1999 Moeny
5,947,215 A 9/1999 Lundell
5,950,743 A 9/1999 Cox
5,957,223 A 9/1999 Doster
5,957,225 A 9/1999 Sinor
5,967,247 A 10/1999 Pessier
5,979,571 A 11/1999 Scott
5,992,547 A 11/1999 Caraway
5,992,548 A 11/1999 Silva
6,021,859 A 2/2000 Tibbitts
6,039,131 A 3/2000 Beaton
6,131,675 A 10/2000 Anderson
6,150,822 A 11/2000 Hong
6,186,251 B1 2/2001 Butcher
6,202,761 B1 3/2001 Forney
6,213,226 B1 4/2001 Eppink
6,223,824 B1 5/2001 Moyes
6,269,893 B1 8/2001 Beaton
6,296,069 B1 10/2001 Lamine
6,332,503 B1 12/2001 Pessier
6,340,064 B2 1/2002 Fielder
6,364,034 B1 4/2002 Schoeffler
6,394,200 B1 5/2002 Watson
6,408,959 B2 6/2002 Bertagnolli
6,439,326 B1 8/2002 Huang
6,474,425 B1 11/2002 Truax
6,484,825 B2 11/2002 Watson
6,484,826 B1 11/2002 Anderson
6,510,906 B1 1/2003 Richert
6,513,606 B1 2/2003 Krueger
6,533,050 B2 3/2003 Molloy
6,594,881 B2 7/2003 Tibbitts
6,601,454 B1 8/2003 Botnan
6,622,803 B2 9/2003 Harvey
6,668,949 B1 12/2003 Rives
6,672,406 B2 1/2004 Beuershausen
6,729,420 B2 5/2004 Mensa-Wilmot
6,732,817 B2 5/2004 Dewey
6,822,579 B2 11/2004 Goswami
6,929,076 B2 8/2005 Fanuel et al.
6,953,096 B2 10/2005 Gledhill
2001/0004946 A1 6/2001 Jensen
2003/0213621 A1 11/2003 Britten
2004/0238221 A1 12/2004 Runia
2004/0256155 A1 12/2004 Kriesels
2007/0114065 A1 5/2007 Hall
2008/0029312 A1 2/2008 Hall
2008/0035380 A1 2/2008 Hall
2008/0035389 A1 2/2008 Hall
2008/0115978 A1 5/2008 Hall
2008/0258536 A1 10/2008 Hall
2008/0309148 A1 12/2008 Hall
2008/0314647 A1 12/2008 Hall
2009/0051211 A1 2/2009 Hall
2009/0200857 A1 8/2009 Hall
2010/0000799 A1 1/2010 Hall
2010/0059288 A1 3/2010 Hall
2010/0059289 A1 3/2010 Hall
2010/0065332 A1 3/2010 Hall
2010/0065338 A1 3/2010 Hall
2010/0065339 A1 3/2010 Hall
2010/0071964 A1 3/2010 Hall
2010/0089648 A1 4/2010 Hall

* cited by examiner

CENTRAL CUTTING REGION OF A DRILLING HEAD ASSEMBLY

BACKGROUND OF THE INVENTION

The present invention relates to a drilling assembly, and more particularly to the central region of a drilling head assembly for boring into formations.

U.S. Pat. No. 5,366,031 to Richards, which is herein incorporated by reference for all that it contains, discloses an auger with a boring head having an arrangement for cutting relatively hard earth formations such as rock. First and second groups of drill bits are mounted to the boring head such that when the head is rotated, each bit in those groups cuts a different path at a different height to provide more than 100% coverage of the work surface being cut, while stabilizing the auger by distributing the down force of the auger over the entire bit rotation. The drill bits also are oriented to ensure bit rotation at relatively large attack angles (the angle the bit forms with the work surface there beneath) of about 50° to 60° to enhance auger penetration rates without detracting from the bit sharpening effect that results from proper bit rotation.

U.S. Pat. No. 3,821,993 to Kniff, which is herein incorporated by reference for all that it contains, discloses an auger arrangement for boring holes in earth formations in which the auger comprises a body with a central cutter arrangement including a pilot cutter on the axis and with laterally extending wing portions on the auger, on each of which is pivotally mounted a wing cutter arranged to swing outwardly when the auger rotates in cutting direction and to swing inwardly when the auger is not rotating or when it is rotating in the reverse direction so that the auger can readily be withdrawn from a hole bored thereby.

U.S. Pat. No. 3,763,942 to Levitt, which is herein incorporated by reference for all that it contains, discloses an auger or boring head, especially for horizontal rock and earth drilling having a circular ring of circumferentially spaced tool bits or teeth, a plurality of spokes or fins with leading ends carrying tool bits or cutting teeth in convex curved or arcuate contours from a central cutting point forwardly of the ring to the periphery of the ring. The cutting teeth on the ring project radially outward from the periphery thereof and are tilted forwardly in the direction of rotation of the auger head. The cutting teeth on the spokes or fins project forwardly, are tilted toward the direction of rotation of the heard and are also tilted backwardly to present the tip end of each tooth in a straight forward direction to the surface while it is cutting. In addition, the teeth are staggered so that successive teeth will not have the same cutting track. A head or socket is provided in the center of the auger head for connection to a drill rod or stem. Large open areas are provided through the ring between the spokes or fins, and the earth or rock cut by the head is free to flow through these spaces to a spiral conveyor which preferably has it leading edge behind one of the spokes or fins.

Examples of auger assembly from the prior art are disclosed in U.S. Pat. No. 2,981,403 to Goodrich, U.S. Pat. No. 2,800,302 to McCleannan, U.S. Pat. No. 4,917,196 to Stiffler, U.S. Pat. No. 5,794,727 to Murray, which are all herein incorporated by reference for all that they contain.

BRIEF SUMMARY OF THE INVENTION

In one aspect of the invention, a drilling assembly comprises a head located on a rotational axis of the assembly and comprises at least one head element. At least one blade extends distally from the head. A plurality of blade degradation elements are rotationally supported on the blade. Each degradation element comprises an attack angle that affects the penetration rate of each degradation element and a laterally offset angle that primarily affects the rotational rate of each degradation element within their holders fixed to the blade. The drilling assembly comprises a central cutting region on each blade. The blade degradation elements within the central cutting region form an angle between 15 and 20 degrees with the rotational axis of the drilling assembly.

The central cutting region may be defined within a 13 inch radius from the rotational axis of the drilling assembly. The central cutting region may also be defined within a six inch radius from the rotational axis of the drilling assembly. The attack angle may be between 16 and 18 degrees. The blade may comprise at least one degradation element. The plurality of blade degradation elements may comprise a wear resistant tip comprising a pointed sintered polycrystalline diamond compact supported on a cemented metal carbide support. The support may be bonded to a cemented metal carbide bolster at a forward diameter, which comprises a cross-sectional thickness less than or substantially equal to a largest diameter of the bolster. The support may be segmented. At least one segment of the support may be press fitted into a cavity of a body of the degradation element. The pointed diamond compact may comprise a greater axial thickness than an immediately adjacent segment of the support. The pointed diamond compact may comprise a greater axial thickness than the support. The pointed diamond compact may comprise a curvature formed in a plane substantially parallel with a central axis of the tip. The curvature may be between 0.050 and 0.110 inch radius of curvature. The assembly may be an auger assembly. The assembly may be a coring bucket assembly.

DETAILED DESCRIPTION OF THE INVENTION AND THE PREFERRED EMBODIMENT

Figure 1:
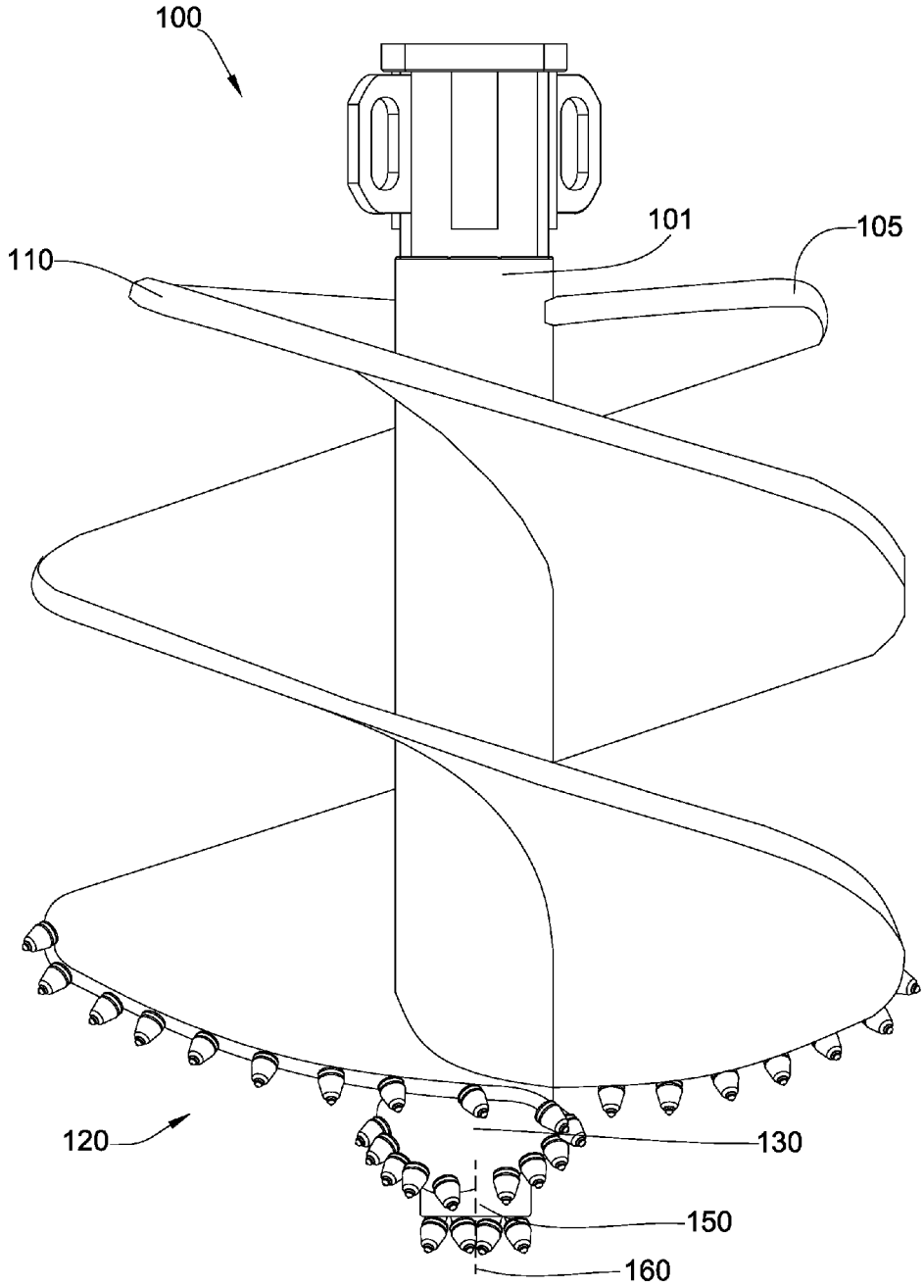
FIG. 1 is a perspective diagram of an embodiment of a drilling assembly.

FIG. 1 is a perspective diagram of an embodiment of a drilling assembly constructed in accordance with the present invention. In the embodiment of FIG. 1, the drilling assembly is a auger assembly. The auger assembly 100 comprises an auger shaft 101, first blade 105, second blade 110 and a central cutting region 120. The first blade 101 and the second blade 110 are arranged in a helical position around the shaft 101 to convey debris to the surface of the area being excavated. The central cutting region 120 includes a boring head 130, first and second blade assemblies and a main head 150. The boring head 130 is secured to one end of the auger shaft 101, and an end portion of the first and second blades 105, 110. The main head 150 is releasably secured to the boring head 130 to facilitate replacement of the main head 150. In any event, the shaft 101, boring head 130, and the main head 150 collectively share a common rotational axis 160.

Figure 2:
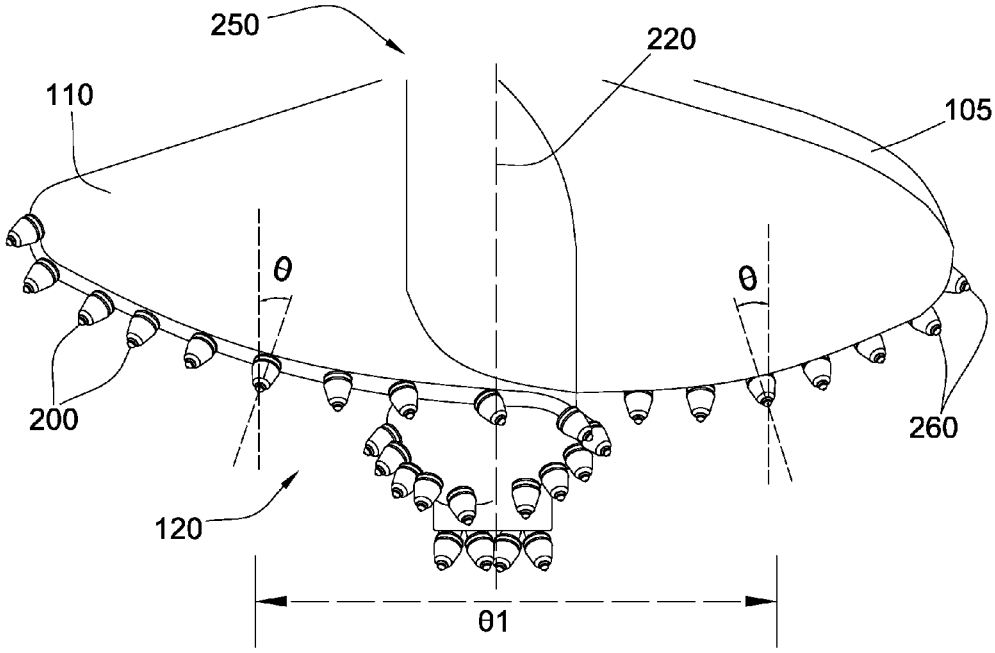
FIG. 2 is a perspective diagram of an embodiment of a drilling head assembly.

Referring to FIG. 2, a 26 inch diameter (ø1), or 13 inch radius, central cutting region 120 is disclosed. Both blades 105, 110 may comprise a plurality of blade degradation elements 200 attached to an edge of the blades 105, 110. The plurality of blade degradation elements 200 may comprise an attack angle (θ) of 15 to 20 degrees. The attack angle is formed between a central axis of the blade degradation element and the rotational axis of the drilling head assembly. A 15 to 20 degree angle for blade degradation elements within the central cutting region is believed to have an optimal performance when the blade degradation cutting elements are enhanced with tips of comprising sintered polycrystalline diamond. In some embodiments, the central cutting region is less than 26 inches in diameter. For example, the diameter may be closer to 12 inches. In some embodiments, the blade degradation elements may form an attack angle of 16 to 18 degrees. Preferably, the attack angle is closer to 17 degrees.

The attack angle determine penetration rate of the drilling assembly. It is believed that the blade degradation elements or the gauge degradation elements that are not within the central cutting region should have attack angles greater than 20 degrees.

Prior art references, such as U.S. Pat. No. 5,366,031 to Richards, teaches the attack angles of all the degradation elements, not just the degradations elements secured close to the rotational axis of the drilling assembly, should form an angle of 30 to 40 degrees. See column 7, lines 6-10. (However, note that Richard's attack angle is defined with reference to a horizontal, while the present invention is defined with reference to the rotational axis of the drilling assembly. The present invention's attack angle is more closely aligned to the Richard's ζ angle, line 9).

Figure 3:
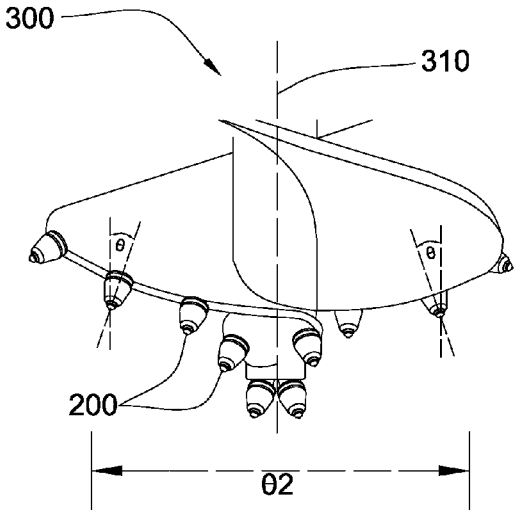
FIG. 3 is a perspective diagram of another embodiment of a drilling head assembly.

FIG. 3 discloses a drilling head assembly with an overall diameter that is just over the central cutting region's diameter. In this embodiment, the majority of the blade degradation elements will form an angle of 15 to 20 degrees. Here, only the gauge degradation elements form an angle greater than 20 degrees.

Figure 4:
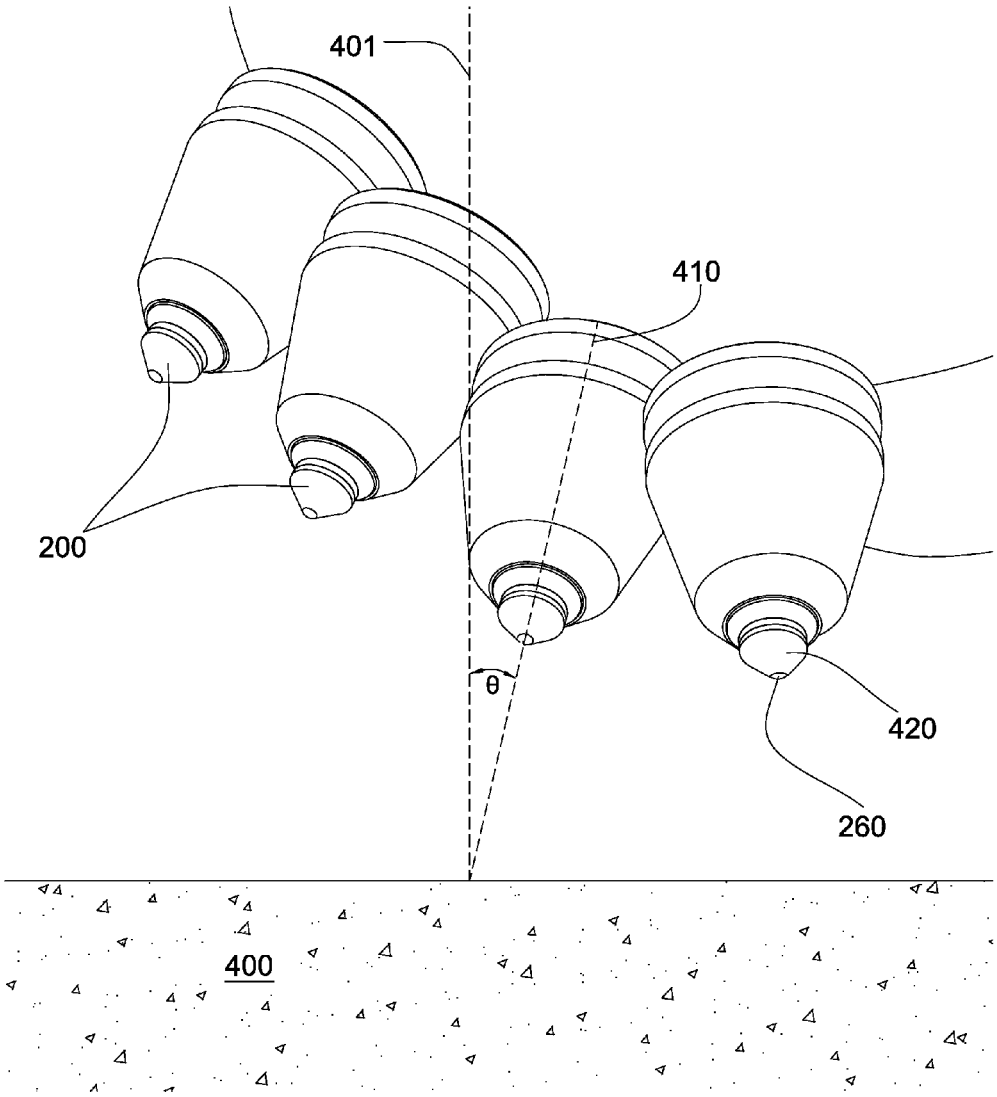
FIG. 4 is a perspective diagram of an embodiment of a plurality of blade degradation elements.

FIG. 4 discloses an embodiment of blade degradation elements 200 attached to either first blade 105 or second blade 110. The attack angle (θ) of each of the degradation elements 200 may be between 15 and 20 degrees, which allows greater penetration rates, and thus faster boring rates. The attack angle (θ) is defined as the angle formed between the vertical axis 401 of a formation 400 and a rotational axis 410 of the degradation element 200.

Figure 5:
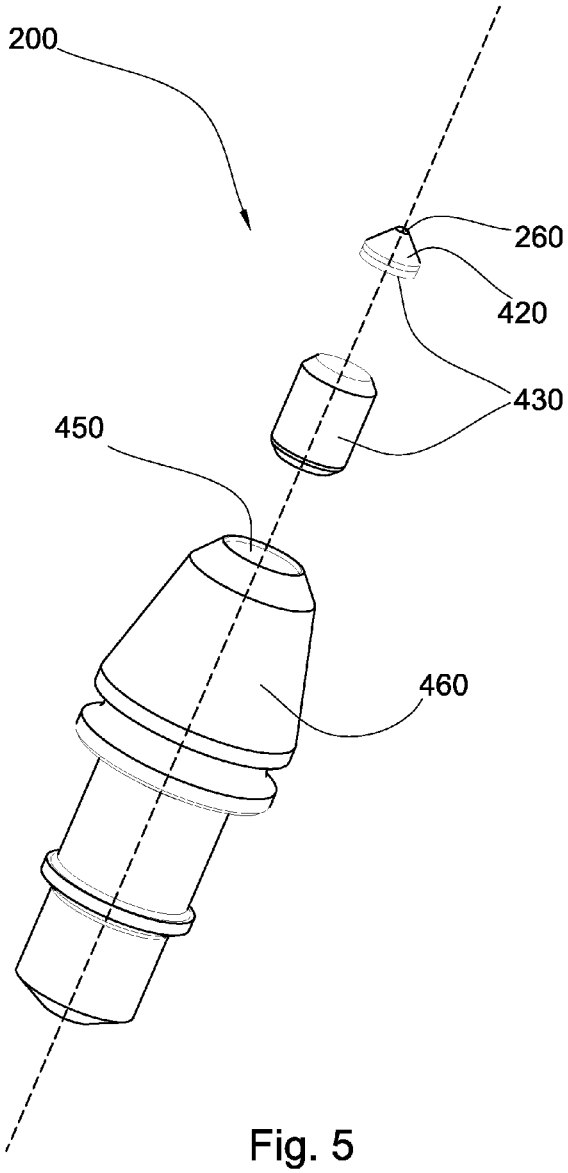
FIG. 5 is an exploded view of a diagram of an embodiment of a blade degradation element.

FIG. 5 discloses an exploded view of an embodiment of a blade degradation element 200. The degradation element 200 may comprise a wear resistant tip 260 comprising a pointed sintered polycrystalline diamond compact 420 supported on a cemented metal carbide support 430. The carbide support 430 may be segmented. At least one segment of the support 430 may be press fit into a cavity 450 of a body of the degradation element 200. In some embodiments, the degradation element 200 may comprise a braze joint. The support 430 may be bonded to a cemented metal carbide bolster 460 at a forward diameter, which comprises a cross-sectional thickness less than or substantially equal to a largest diameter of the bolster 460. The bolster 460 may comprise cemented metal carbide, a steel matrix material, or other material and may be press fit or brazed to a drill bit body. The pointed diamond compact 420 may comprise a greater axial thickness than an immediately adjacent segment of the support 430. Such composition of the tip 260 of the degradation element 200 may increase the longevity of the degradation elements 200. In some embodiments, the pointed diamond compact 260 may comprise a greater axial thickness than the support 430.

Figure 6:
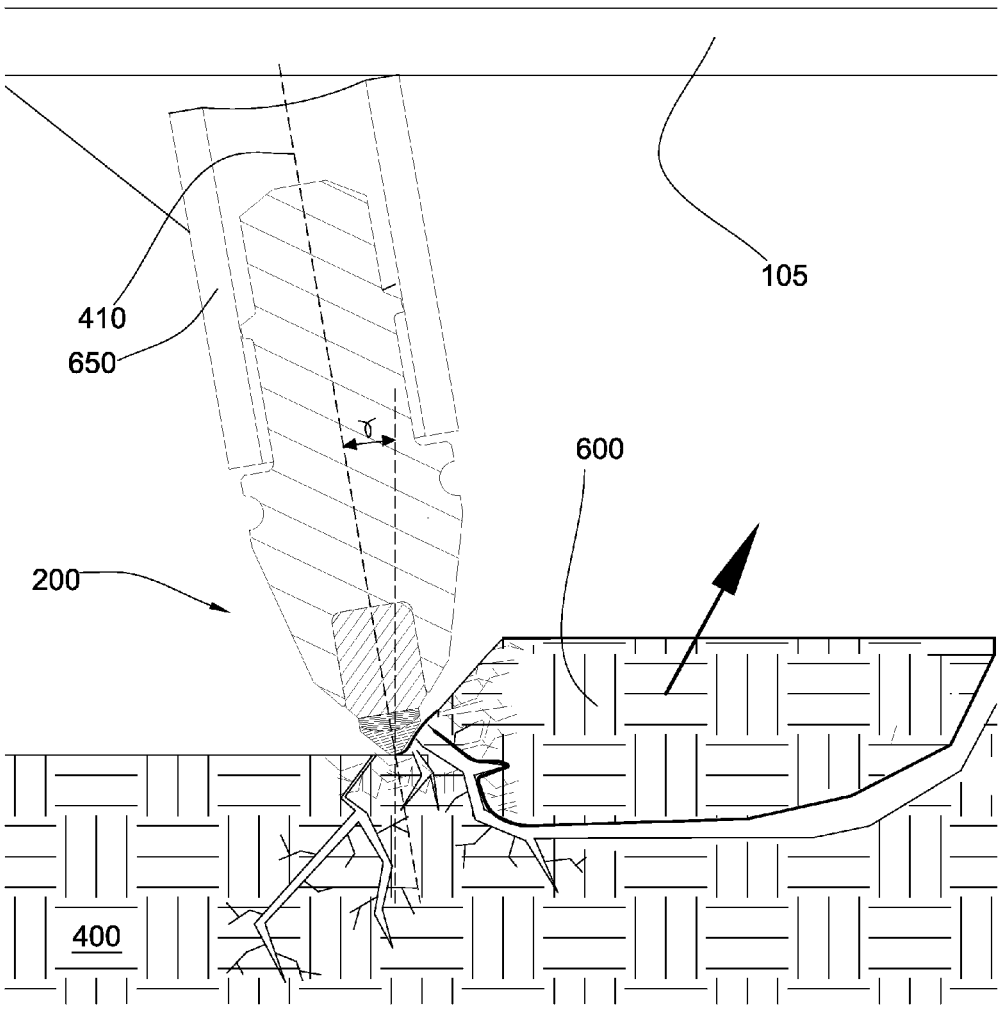
FIG. 6 is a cross-sectional diagram of an embodiment of a blade degradation element.

Referring to FIG. 6, the degradation element 200 may be attached to a holder 650 mounted on the blades 105, 110. Each degradation element 200 induces a load into the formation 400, which in turn imposes a reaction force on the pick. The reaction forces may depend on WOB, rpm, formation type, torque, or combinations thereof. In some embodiments, a balance between penetration rate and lifespan of the blade degradation element 200 may be obtained when a resultant force vector aligns with an axis 410 of the degradation element 200. The fractures may propagate in the formation 400, resulting in a removal of chips 600 of formation 400.

Figure 7:
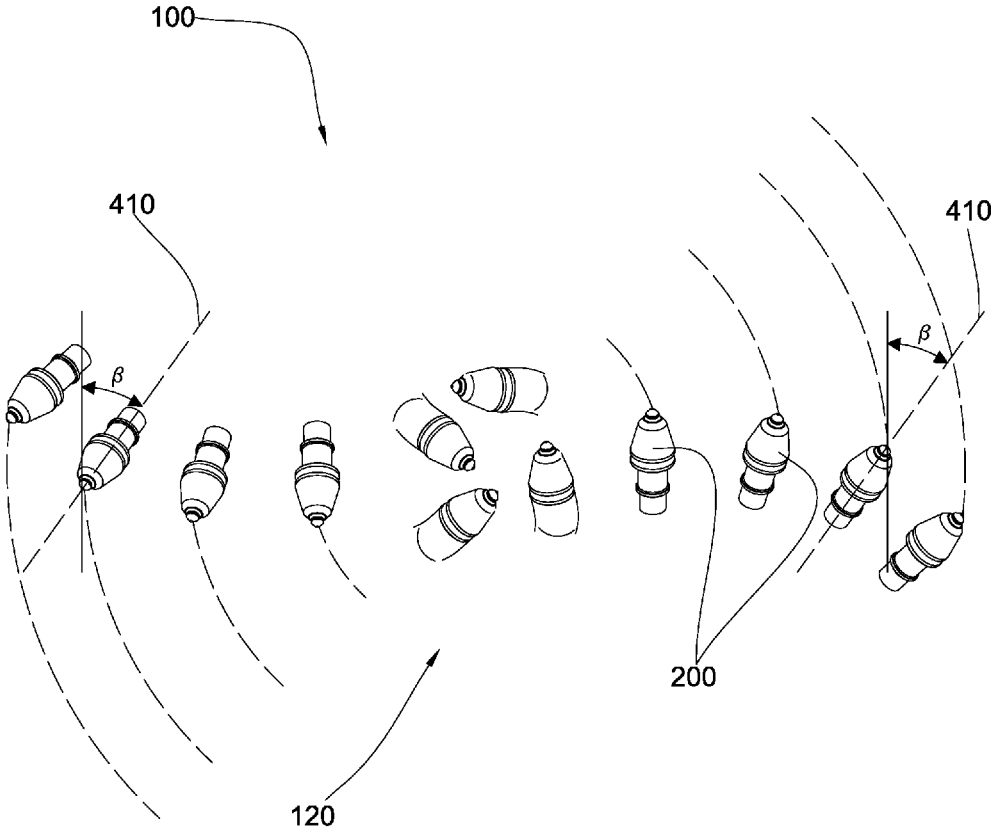
FIG. 7 is an orthogonal diagram of an embodiment of a drilling head assembly.

Referring to FIG. 7, a bottom view of an embodiment of an auger assembly 100 is shown. The degradation elements 200 may rotate while following a helical path. Each degradation element 200 may follow a separate helical path as the auger assembly 100 drills deeper into a formation. Each degradation element 200 may comprise a laterally offset angle (β), which imposes a lateral force on the pick adapted to cause the pick to rotate. If the rotational axis 410 of the degradation element 200 is tangent to the helical cutting path, the offset angle (β) is generally zero. The degradation elements 200 may continue to rotate in their holders (not shown) for a wide range of offset angle (β).

Figure 8:
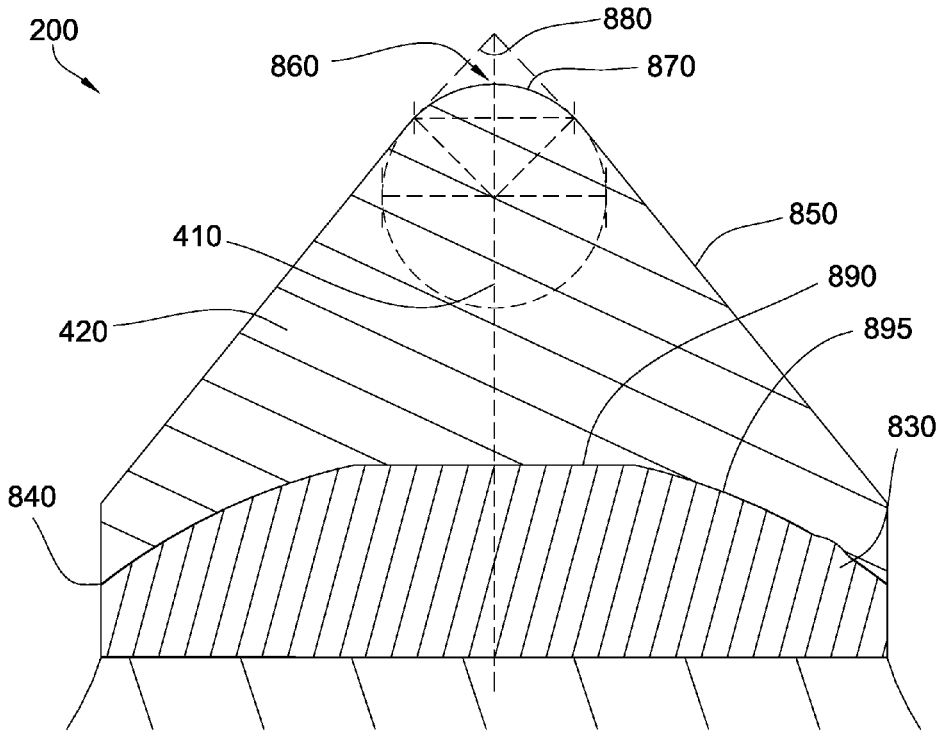
FIG. 8 is a cross-sectional diagram of another embodiment of a tip.

Referring to FIG. 8, the degradation element 200 may comprise a sintered polycrystalline diamond compact 420 bonded to a cemented metal carbide substrate 830 at a non-planar interface 840. The degradation element 200 may comprise a substantially pointed geometry 850 and an apex 860. The apex 860 may comprise a curvature 870 formed in a plane substantially parallel with a central axis of the tip 410. The curvature 870 may be between 0.050 and 0.110 inch radius of curvature. In some embodiments, the curvature 870 may comprise a variable radius of curvature, a portion of a parabola, a portion of a hyperbola, a portion of a catenary, or a parametric spline. An included angle 880 is formed by the walls of the pointed geometry 850. In some embodiments, the included angle 880 may be between 75 degrees and 90 degrees. Non-planar interface 840 may comprise an elevated flatted region 890 that connects to a cylindrical portion of the substrate 830 by a tapered section 895. In some embodiments, the diamond compact 420 may comprise a volume with less than 5 percent catalyst metal concentration, while 95 percent of the interstices in the sintered polycrystalline diamond comprise a catalyst.

Figure 9:
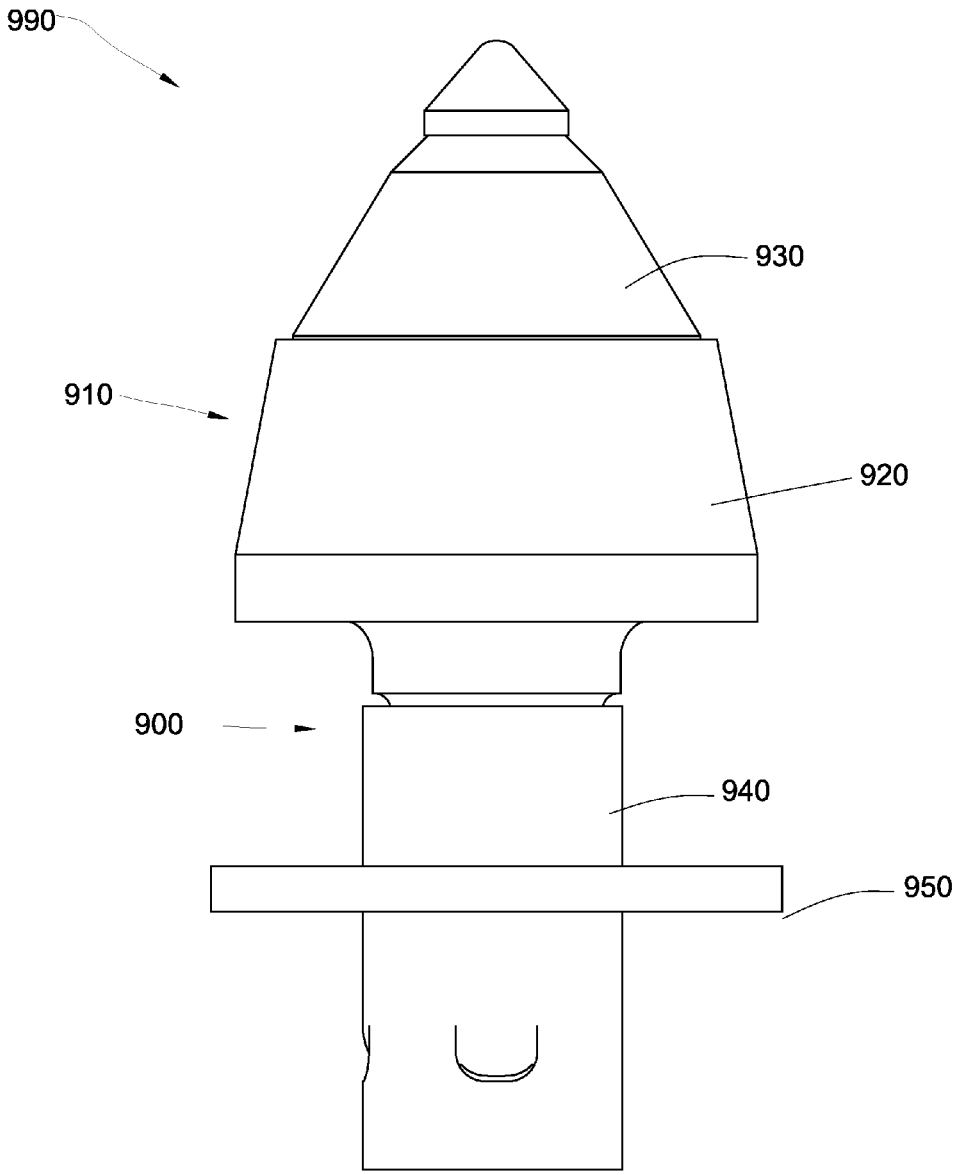
FIG. 9 is an orthogonal diagram of another embodiment of a blade degradation element.

FIG. 9 discloses an embodiment of a blade degradation element 990 which may be used in machines in mining, asphalt milling, or trenching industries. The element 990 may be used in auger assembly 100. The element 990 may comprise a shank 900 and a body 910, the body 910 being divided into first and second segments 920 & 930. The shank 900 may be adapted to be attached to a driving mechanism. A protective spring sleeve 940 may be disposed around the shank 900 both for protection and to allow the degradation element 990 to be press fit into the holder (not shown) while still being able to rotate. A washer 950 may be disposed around the shank 900 such that when the element 990 is inserted into the holder, the washer 950 protects an upper surface of the holder and also facilitates rotation of the element 990. The washer 950 and sleeve 940 may be advantageous since they may protect the holder which may be costly to replace.

The wear resistant tips 260 may comprise a pointed sintered polycrystalline diamond compact supported on a cemented metal carbide support. Chemical vapor deposition (CVD) technique may be used and may provide precise shapes, but it may not provide as strong bonding between diamond crystals. Preferably, sintered diamond is used, which is subjected to high temperature and high pressure resulting in strong bonds between diamond crystals. Natural diamonds may also be used.

Figure 10:
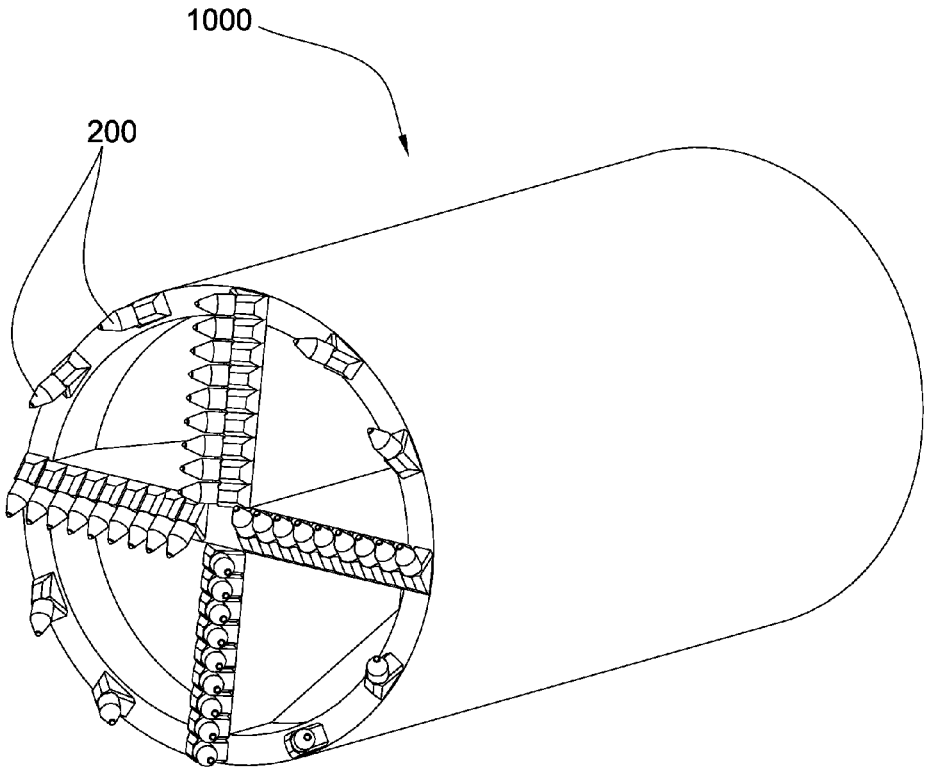
FIG. 10 is a perspective diagram of an embodiment of a drilling assembly.

FIG. 10 discloses that the present invention may be incorporated into a coring bucket assembly 1000 as well as other drilling assemblies. The assembly 1000 may comprise a plurality of degradation elements 200 at one end disposed in a particular order as well as particular orientation as shown in the figure. The assembly 1000 may be used to drill through clay, soft soil, hard rock, or combinations thereof.

In some embodiments of the invention, the picks are rigidly fixed within the holders such that there is no rotation. In some embodiments, the picks are allowed to rotate, but the assembly comprises a mechanism that restricts free rotation causing the picks to rotate slower. This may be advantageous by reducing the wear between the shank of the pick and the inner bore of the holder.

Whereas the present invention has been described in particular relation to the drawings attached hereto, it should be understood that other and further modifications apart from those shown or suggested herein, may be made within the scope and spirit of the present invention.

What is claimed is:

1. A drilling assembly, comprising:

a head located on a rotational axis of the assembly;

at least one blade extending distally from the head;

a plurality of blade degradation elements being rotationally supported on the blade;

each degradation element comprising an attack angle formed between a central axis of the degradation element and the rotational axis of the assembly that affects the penetration rate of each degradation element and a laterally offset angle formed between the central axis of the degradation element and a line tangent to a helical cutting path of the degradation element that primarily affects the rotational rate of each degradation element within their holders fixed to the blade;

wherein the plurality of blade degradation elements comprise a wear resistant tip comprising a pointed sintered polycrystalline diamond compact supported on a cemented metal carbide support; and a central cutting region of each blade;

wherein the attack angle of each blade degradation element within the central cutting region is between 15 and 20 degrees.

2. The assembly of claim 1, wherein the central cutting region is defined within a 13 inch radius from the rotational axis of the drilling assembly.

3. The assembly of claim 1, wherein the central cutting region is defined within a six inch radius from the rotational axis of the drilling assembly.

4. The assembly of claim 3, wherein the attack angle is 16 to 18 degrees.

5. The assembly of claim 1, wherein the blade comprises at least one degradation element.

6. The assembly of claim 1, wherein the cemented metal carbide support is bonded to a cemented metal carbide bolster at a forward diameter, which comprises a cross sectional thickness less than or substantially equal to a largest diameter of the bolster.

7. The assembly of claim 1, wherein the cemented metal carbide support is segmented.

8. The assembly of claim 7, wherein at least one segment of the cemented metal carbide support is press fit into a cavity of a body of the degradation element.

9. The assembly of claim 7, wherein the pointed diamond compact comprises a greater axial thickness than an immediately adjacent segment of the cemented metal carbide support.

10. The assembly of claim 1, wherein the pointed diamond compact comprises a greater axial thickness than the cemented metal carbide support.

11. The assembly of claim 1, wherein the pointed diamond compact comprises a curvature formed in a plane substantially parallel with a central axis of the tip.

12. The assembly of claim 11, wherein the curvature is between 0.050 and 0.110 inch radius of curvature.

13. The assembly of claim 1, wherein the assembly is an auger assembly.

14. A drilling assembly, comprising:

a head located on a rotational axis of the assembly;

at least one blade extending distally from the head;

a plurality of blade degradation elements being rotationally supported on the blade;

each degradation element comprising an attack angle formed between a central axis of the degradation element and the rotational axis of the assembly that affects the penetration rate of each degradation element;

wherein the plurality of blade degradation elements comprise a wear resistant tip comprising a pointed sintered polycrystalline diamond compact supported on a cemented metal carbide support; and a central cutting region of each blade;

wherein the attack angle of each blade degradation element within the central cutting region is between 15 and 20 degrees.

* * * * *